US005388384A

United States Patent [19]

Purkey et al.

[11] Patent Number: 5,388,384

[45] Date of Patent: Feb. 14, 1995

[54] AUTOMATIC CODE DATE APPLICATION DEVICE

[76] Inventors: Todd M. Purkey, 943 Reynard SE., Grand Rapids, Mich. 49507; Hulette K. Ash, 4284-5 Turtle Bend, SW., Grandville, Mich. 49418

[21] Appl. No.: 146,993

[22] Filed: Nov. 2, 1993

[51] Int. Cl.[6] ..... B65B 57/02

[52] U.S. Cl. ..... 53/64; 53/131.2; 53/512; 53/557

[58] Field of Search ..... 53/131.2, 570, 512, 53/557, 64, 284.7, 502, 434

[56] References Cited

U.S. PATENT DOCUMENTS

| | | | |
|---|---|---|---|
| 3,194,710 | 7/1965 | Stremke et al. | 53/131.2 |
| 3,732,966 | 5/1973 | Treiber | 53/131.2 |
| 3,777,445 | 12/1973 | Anderson | 53/131.2 |
| 4,581,764 | 4/1986 | Plock | 53/434 |
| 4,583,345 | 4/1986 | Hirosaki | 53/131.2 |
| 4,903,459 | 2/1990 | Okinaka | 53/434 |
| 4,991,374 | 2/1991 | Rademacher | 53/131.2 |
| 5,062,252 | 11/1991 | Kupcikevicius | 53/434 |

FOREIGN PATENT DOCUMENTS

| | | | |
|---|---|---|---|
| 604260 | 8/1960 | Canada | 53/131.2 |
| 2375098 | 7/1978 | France | 53/131.2 |

*Primary Examiner*—Daniel C. Crane

[57] ABSTRACT

An automatic code date application device for labelling packages which includes a package staging area, a conveyor for moving staged packages sequentially along a predetermined path of travel, a code date application device automatically applying a code date to the sequentially moving packages, and package completion elements positioned to receive and complete the moving packages bearing the applied code date.

9 Claims, 1 Drawing Sheet

AUTOMATIC CODE DATE APPLICATION DEVICE

BACKGROUND OF THE INVENTION

1. Field of the Invention

The present invention relates generally to code date application devices and more particularly to an automatic code date application device for applying code dates to a plurality of sequentially moving irregularly shaped packages.

2. Description of the Prior Art

Food products for the most part require the application of a critical date on the finished product package, usually a "sell-by" date that conveys to the purchaser/-consumer the need to consume the packaged article prior to that date. These dates are usually manually applied with a stamp or other appropriate apparatus manipulated by an operator. Such an operation is obviously expensive because of labor costs and in many cases causes injuries in the form of carpal tunnel or other afflictions attributable to the constant motion of the operator's arm and hand in applying the code to the package.

Manual application has for the most part been necessary because many food packages are irregularly shaped to conform to the general configuration of the product. For example, hams are usually shrink-wrapped with appropriate packaging material so that the final package follows the contour of the ham surface. Applying uniform code dates automatically to such products is extremely difficult in that the products are not uniformly configured and there has been no discernable location where the code can be applied automatically at the same location with any degree of consistency.

Many attempts to automate the code date application process have been made by varying locations where the code application step would take place, however this has proved to be expensive and again not reliable to any comfortable degree.

Thus, there is a need to automate the process of applying code dates to food products, particularly those of irregular shape, in order to increase the efficiency of the operation, reduce labor costs and avoid personal injuries to operators that normally occur in such operations. The present invention has been developed with that objective in mind.

OBJECTIVES AND SUMMARY OF THE INVENTION

It is therefore a primary objective of the present invention to provide an automatic code date application device that will reduce personal injury attributable to operators manually applying such codes to irregularly shaped products.

Another objective of the present invention is to provide a device of the type described that will reduce labor costs associated with the application of code dates to food products.

Yet another objective of the present invention is to provide a device of the type described that results in the positioning of a code date automatically on a food package consistently at the same location.

A further objective of the present invention is to provide a device of the type described wherein the code date is provided on the finished food product at a location where the surface of the packages are substantially similar.

To meet these objectives, the present code date application device contains a package staging means, a conveyor for moving the staged packages sequentially along a predetermined path of travel, a code date application apparatus automatically applying the code date to the moving packages, and appropriate finishing elements to receive and complete the moving packages bearing the applied code dates.

Thus there has been outlined the more important features of the invention in order that the description that follows may be better understood and in order that this contribution may be better appreciated. There are additional features of the invention that will be described hereinafter that will also form the subject matter of the claims appended hereto. In this respect, it is to be understood that the invention is not limited in its application to the details of construction and to the arrangements of the components set forth in the following description or illustrated in the drawings. The invention is capable of other embodiments and of being practiced and carried out in several ways. The phraseology and terminology employed herein are for the purpose of description and are not to be regarded as limiting. Those skilled in the art will appreciate that the concept upon which this disclosure is based may readily be utilized as a basis for the design of other structures, methods, and systems for carrying out the several purposes of the invention. In that respect, the claims are to be regarded as including such equivalent constructions insofar as they do not depart from the spirit and scope of the present invention.

Consequently, the objectives set forth above, together with other objectives of the invention, along with the various features of novelty which characterize the invention, will become more apparent after consideration of the following detailed description of the invention taken in conjunction with the accompanying drawings wherein like characters of reference designate like parts throughout the several views.

DETAILED DESCRIPTION OF THE PREFERRED EMBODIMENT

Figure 1:
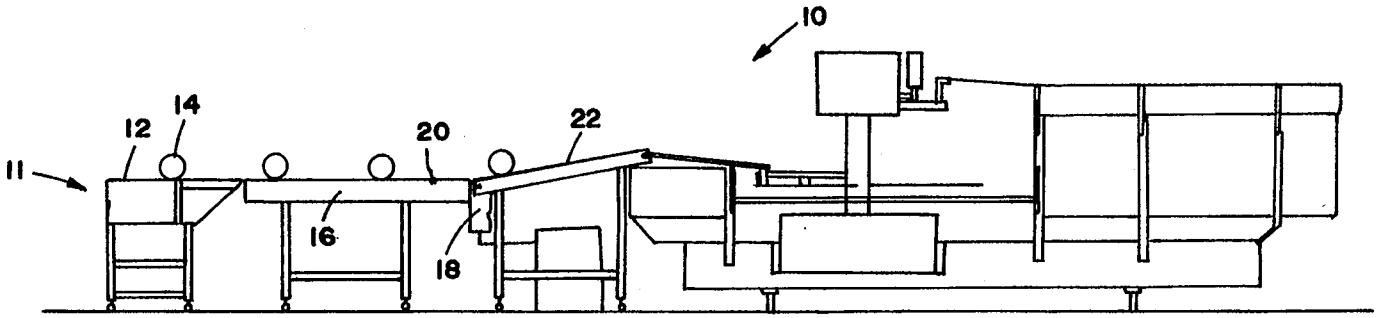
FIG. 1 is a side elevational and schematic view of the automatic code date application device comprising the present invention.
Figure 2:
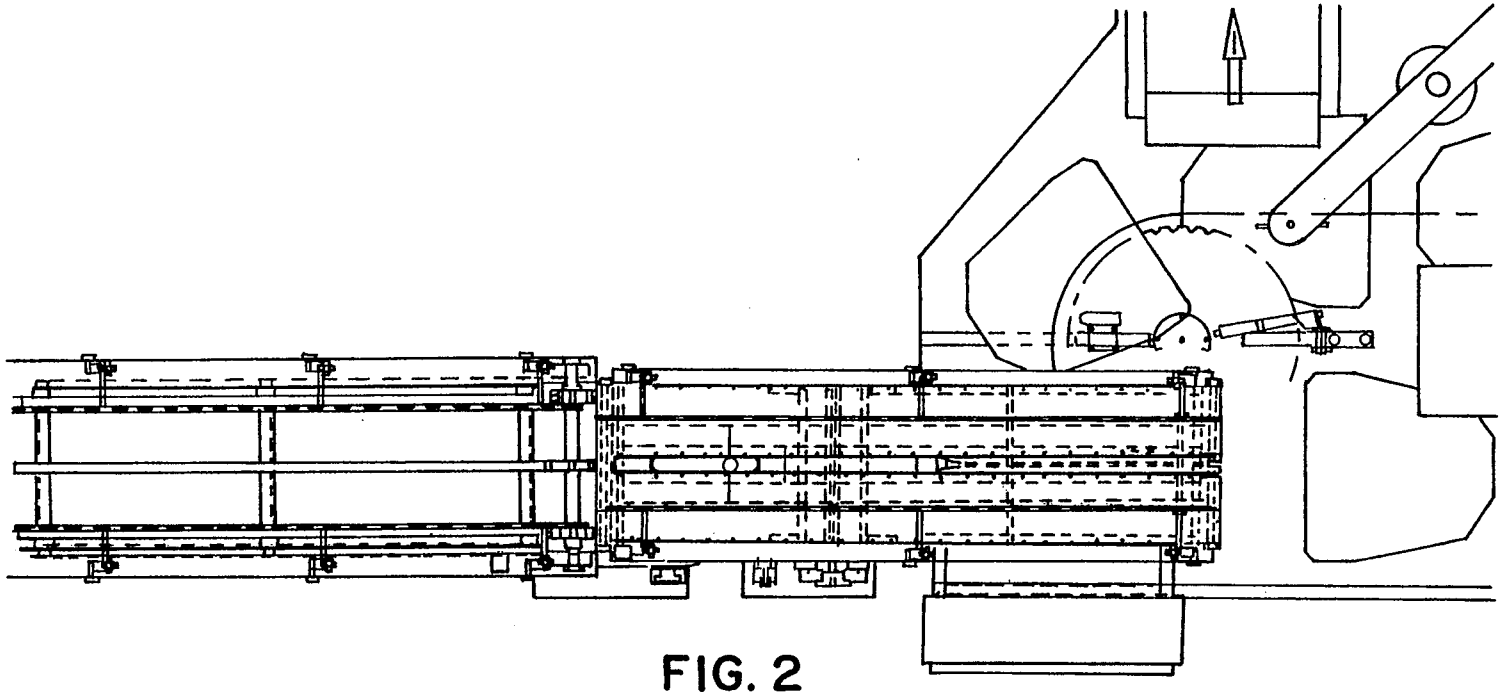
FIG. 2 is a plan and schematic view of the device shown in FIG. 1.

Referring now to the drawings, a food product packaging and labelling station shown generally as 10 includes an automatic code date application device having a package staging area 11 comprising a bag loader 12 where the food product is positioned within the plastic or cellophane bag for code application and subsequent finishing. Package 14 moves from the bag loader to the conveyor 16 that carries packages to the code date application device 18. Package 14 programs the code date application device 18 by passing a photocell 20 before moving on to a second split conveyor 22. Conveyor 22 is split into 2 sections so that the code date application device 18 can be positioned in the opening between the 2 conveyor sections to address the bottom side of the package 14 moving above. The bottom side of the package 14 is substantially flat and provides an even and consistent surface to which the code can be applied with efficiency, consistency, and uniformity.

After application of the code, the sequentially moving packages 14 go into the package finishing area where the bag is sealed or otherwise closed, subsequently heat-shrunk to snugly conform to the exterior surface of the product, and moved thereafter to a collecting and inspection area. Additional means may be provided to position the individual stamped and closed packaged products within receiving containers to be subsequently moved to other locations.

It has been found acceptable to utilize a conventional ink-jet coder, preferably one like that designated VIDEOJET manufactured and sold by Videojet Systems International, Inc., located in Kalamazoo, Mich. Such ink-jet coders have traditionally been used to label fiat package stock prior to any formation of the package about the food product since such stock is in a uniformly flat condition at all times prior to the packaging process.

Obviously other switches actuated by appropriately positioned photocells may be included in various locations to achieve other packaging steps that may be necessary for any particular package form.

The utilization of a split conveyor to position the code application device between the separated sections of the conveyor and beneath the passing package has provided the most significant part of the present invention since it enables the consistent and reliable application of a code to sequentially moving, nonuniformly configured packages on the underneath side of each package as it passes over the application device.

From the preceding description, it can be seen that a device for automatically applying code dates to product packages has been provided that will meet all of the advantages of prior art devices and offer additional advantages not offered by such devices. Moreover, the use of a continuous conveyor system and, a split conveyor section for that system, provides the essential stabilization feature for the invention to result in consistent and efficient code application to a package at the same location during each operation.

With respect to the foregoing description, the optimum dimensional relationship to the parts of the invention including variations in size, materials, shape, form, function, and manner of operation, used in assembly, are deemed readily apparent and obviously those skilled in the art and all equivalent relationships illustrated in the drawings and described in the application are intended to be encompassed herein.

The foregoing is considered illustrative only of the principles of the invention. Since numerous modifications and changes will quickly occur to those skilled in the art, it is intended not to limit the invention to the precise description and operation of the embodiment shown. All suitable modifications and equivalents that fall within the scope of the appended claims are deemed within the present inventive concept.

We claim:

1. An automatic code date application device comprising: package staging means; split conveyor means including two conveyor sections separated by an opening for moving the staged packages sequentially along a pre-determined path of travel; code date application means positioned between the two conveyor sections and within the opening automatically applying the code date to the sequentially moving packages; and packaging finishing means positioned to receive and complete the moving packages bearing applied code dates wherein the package staging means includes bag loader means communicating with the conveyor means having means for opening a package bag and positioning a product to be packaged therein.

2. The device as claimed in claim 1 wherein the code date application means includes printing means for printing the code date on an adjacent package, sensing means for detecting the presence of the adjacent package and actuating the printing means to apply the code date on the adjacent package.

3. The device as claimed in claim 2 wherein the package finishing means includes package sealing means and the package finishing means further includes package shrinkage means for evacuating air from the sealed package and closely forming a package around the packaged product.

4. The claim as claimed in claim 3 further comprising a dryer means associated with the printing means to remove moisture from and dry the applied code on the package wherein the package staging means includes bag loader means communicating with the conveyor means having means for opening a package bag and positioning a product to be packaged therein.

5. An automatic code date application device comprising: package staging means; split conveyor means including two conveyor sections separated by an opening for moving the staged packages sequentially along a pre-determined path of travel; code date application means positioned between the two conveyor sections and within the opening automatically applying the code date to the sequentially moving packages; and packaging finishing means positioned to receive and complete the moving packages bearing applied code dates wherein the package finishing means further includes package shrinkage means for evacuating air from the sealed package and closely forming the package around the packaged product.

6. The device as claimed in claim 5 wherein the code date application means includes printing means for printing the code date on an adjacent package, sensing means for detecting the presence of the adjacent package, and activating the printing means to apply the code date on the adjacent package.

7. The device as claimed in claim 5 wherein the package staging means includes bag loader means communicating with the conveyor means having means for opening a package bag and positioning a product to be packaged therein.

8. An automatic code date application device comprising: package staging means; split conveyor means including two conveyor sections separated by an opening for moving the stages packages sequentially along a pre-determined path of travel; code date application means positioned between the two conveyor sections and within the opening automatically applying the code date to the sequentially moving packages; and packaging finishing means positioned to receive and complete the moving packages bearing applied code dates wherein the package finishing means further includes package shrinkage means for evacuating air from the sealed package and closely forming the package around the packaged product.

9. An automatic code date application device comprising: package staging means; split conveyor means including two conveyor sections separated by an opening for moving the staged packages sequentially along a pre-determined path of travel; code date application means positioned between the two conveyor sections and within the opening automatically applying the code date to the sequentially moving packages; and packaging finishing means positioned to receive and complete the moving packages bearing applied code dates wherein the dryer means includes a first dryer to remove moisture from the package prior to application of the code by the printing means and a second dryer to dry the applied code after application of the code by the printing means.

* * * * *